US007753684B1

(12) United States Patent
Chuang

(10) Patent No.: US 7,753,684 B1
(45) Date of Patent: Jul. 13, 2010

(54) CONNECTING DEVICE WITH A MOVABLE CONNECTOR

(75) Inventor: Chia-Ming Chuang, Tainan County (TW)

(73) Assignee: Micro-Star Int'l Co., Ltd., Jung-He, Taipei Hsien (TW)

( * ) Notice: Subject to any disclaimer, the term of this patent is extended or adjusted under 35 U.S.C. 154(b) by 0 days.

(21) Appl. No.: 12/558,568

(22) Filed: Sep. 13, 2009

(30) Foreign Application Priority Data

Jun. 1, 2009 (TW) ..... 98209546 U

(51) Int. Cl.
*H01R 41/00* (2006.01)

(52) U.S. Cl. ..... 439/31; 439/640

(58) Field of Classification Search ..... 439/31, 439/165, 173, 534, 640
See application file for complete search history.

(56) References Cited

U.S. PATENT DOCUMENTS 5,174,761 A * 12/1992 Kodaira ..... 439/31
5,603,629 A * 2/1997 DeFrasne et al. ..... 439/331
5,813,878 A * 9/1998 Kuwata et al. ..... 439/326
6,951,472 B2 * 10/2005 Shih ..... 439/326
7,160,129 B2 * 1/2007 Yin ..... 439/331
7,232,326 B2 * 6/2007 Uchida et al. ..... 439/326
7,476,106 B1 * 1/2009 Wu et al. ..... 439/67

* cited by examiner

*Primary Examiner*—Thanh-Tam T Le
(74) *Attorney, Agent, or Firm*—Winston Hsu

(57) ABSTRACT

A connecting device includes at least one connector and a base. The connector includes a connecting slot for electrically connecting to an electronic device, a first pivoting structure disposed on the connecting slot, and a first positioning structure disposed on the connecting slot. The base includes at least one second pivoting structure pivoted to the first pivoting structure so that the connector is capable of rotating relative to the base, at least one second positioning structure for connecting with the first positioning structure so as to fix the connector and the base, and at least one pin set electrically connected to a circuit board and the connector so as to transmit signals between the circuit board and the electronic device.

21 Claims, 10 Drawing Sheets

CONNECTING DEVICE WITH A MOVABLE CONNECTOR

BACKGROUND OF THE INVENTION

1. Field of the Invention

The present invention relates to a connecting device, and more particularly, to a connecting device with a movable connector.

2. Description of the Prior Art

A conventional connector is for fixing an electronic device at a predetermined position of a circuit board directly, so that the electronic device is electrically connected to the circuit board for transmitting signals. Thus, a connecting slot of the electronic device has to be inserted into the conventional connector at a predetermined installing direction. However, installation of the conventional connector spends more labor hours and has inconvenient assembly. If a user assembles the electronic device divergent from the predetermined installing direction, the connecting slot of the electronic device might be damaged easily resulting in functional failure. And if the installing direction of the electronic device needs to be changed, the conventional connector needs to be changed to conform to the corresponding installing direction. Therefore, manufacturing cost is raised, and assembly of the conventional connector is inconvenient.

SUMMARY OF THE INVENTION

According to the claimed invention, a connecting device with a movable connector includes at least one connector and a base for holding the connector. The connector includes a connecting slot for electrically connecting to an electronic device so as to transmit a signal to the electronic device, a first pivoting structure disposed on the connecting slot, and a first positioning structure disposed on the connecting slot. The base includes at least one second pivoting structure pivoted to the first pivoting structure so that the connector rotates relative to the base, at least one second positioning structure for connecting with the first positioning structure so as to fix the connector and the base, and at least one pin set electrically connected to a circuit board and the connector so as to transmit the signal between the circuit board and the electronic device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
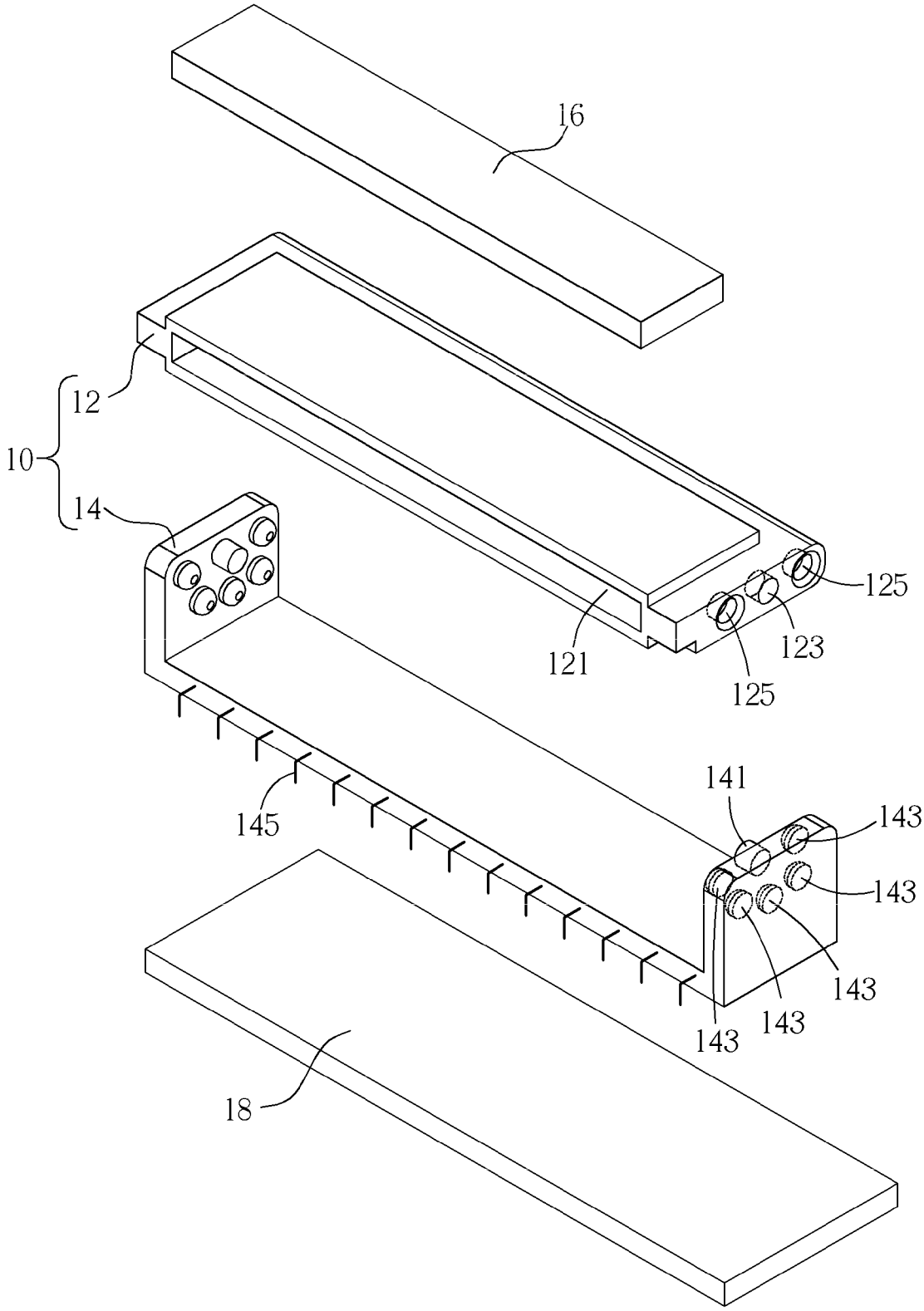
FIG. 1 is an exploded diagram of components of a connecting device of the present invention.

Please refer to FIG. 1. FIG. 1 is an exploded diagram of components of a connecting device 10 of the present invention. The connecting device 10 includes at least one connector 12, and a base 14 for holding the connector 12. The connector 12 includes a connecting slot 121 for electrically connecting to an electronic device 16 so as to transmit a signal to the electronic device 16, a first pivoting structure 123 disposed on the connecting slot 121, and a first positioning structure 125 disposed on the connecting slot 121. The base 14 includes at least one second pivoting structure 141 pivoted to the first pivoting structure 123 so that the connector 12 can rotate relative to the base 14. The base 14 further includes at least one second positioning structure 143 for connecting with the first positioning structure 125 so as to fix the connector 12 and the base 14, and at least one pin set 145 electrically connected to a circuit board 18 at one end and electrically connected to the connector 12 at the other end so as to transmit the signal between the circuit board 18 and the electronic device 16. The first pivoting structure 123 and the first positioning structure 125 can be disposed on a same side or different sides of the connecting slot 121 respectively. The electronic device 16 can be a hard disc, an optical disk drive, and so on.

Figure 2:
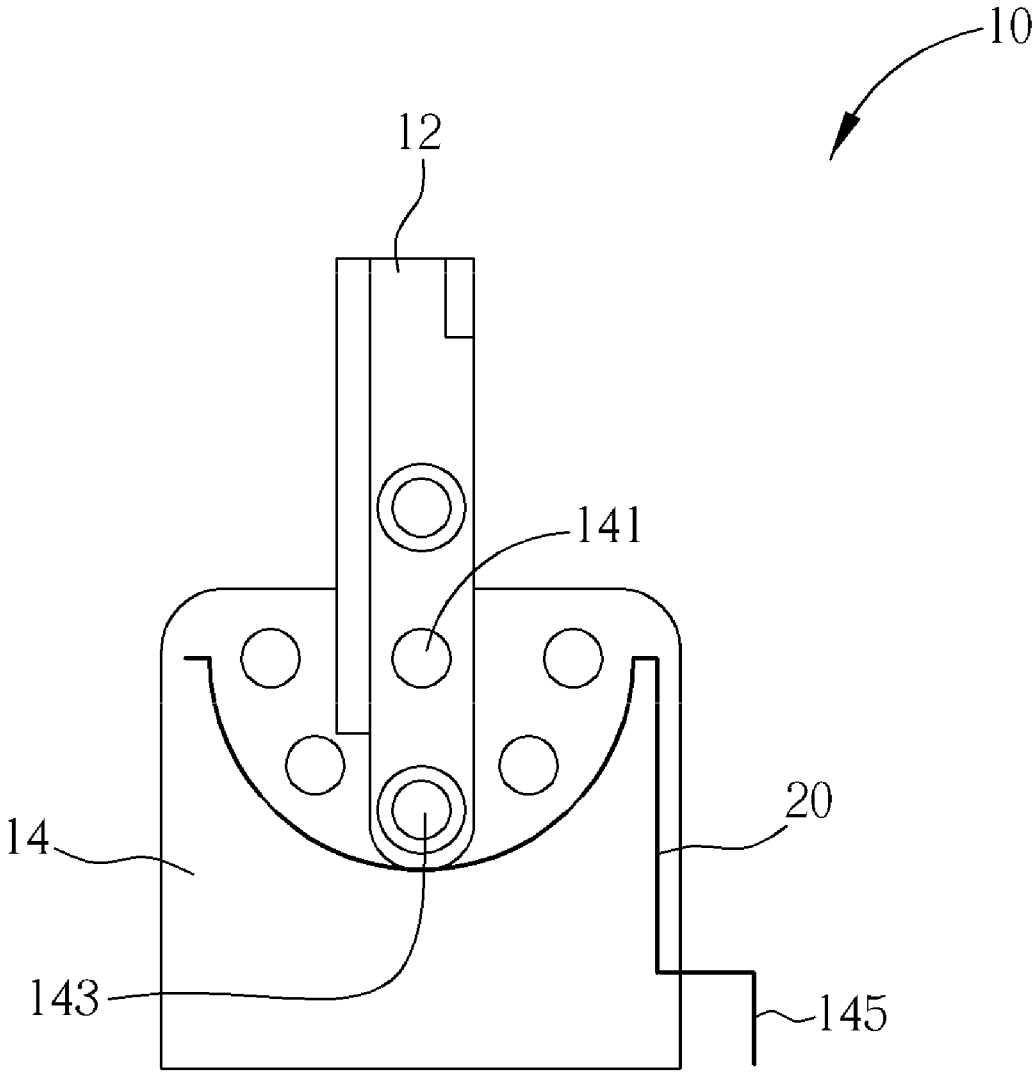
FIG. 2 to FIG. 4 are sectional views of a connector of the connecting device at different positions according to a first embodiment of the present invention.
Figure 3:
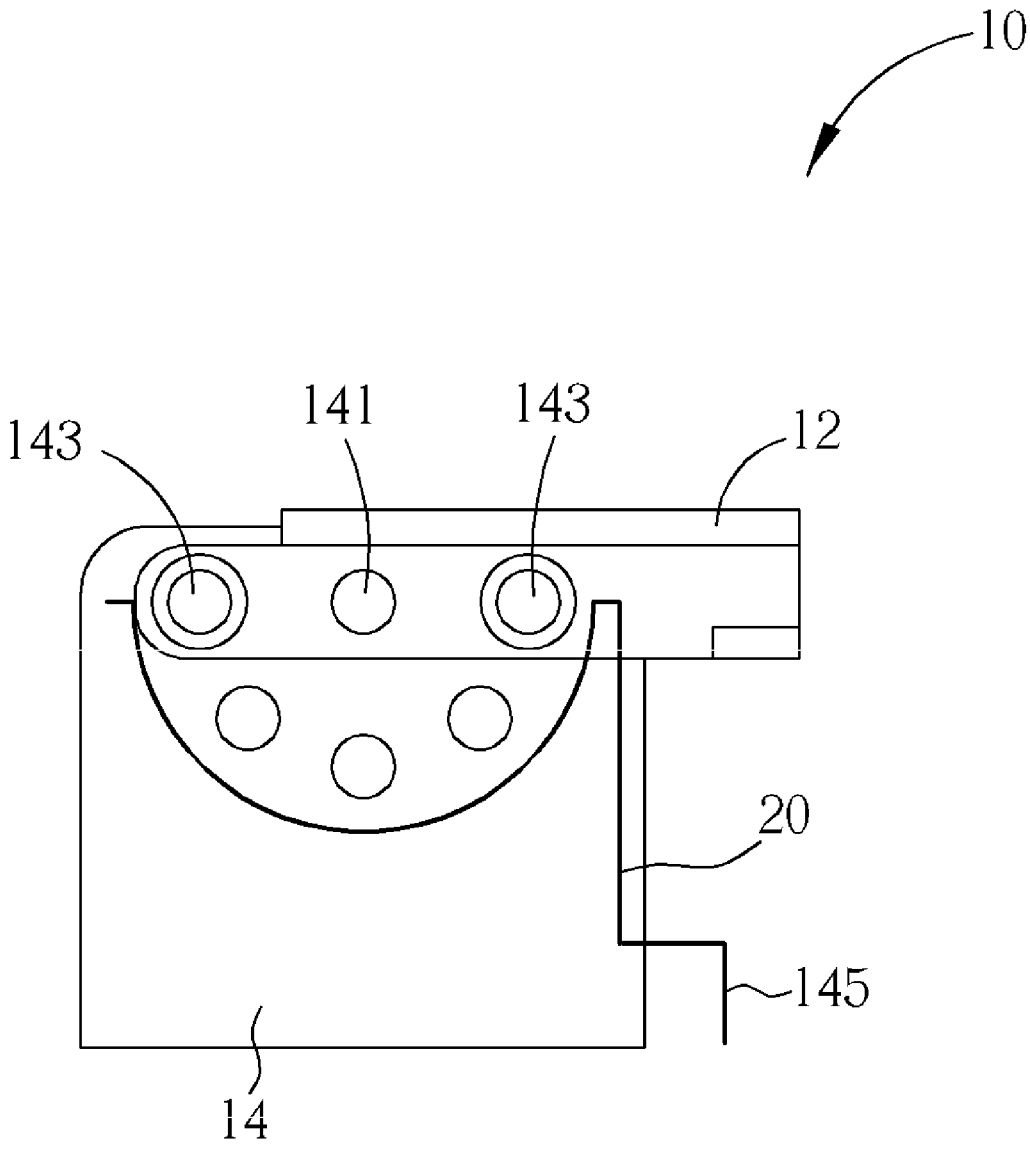
Figure 4:
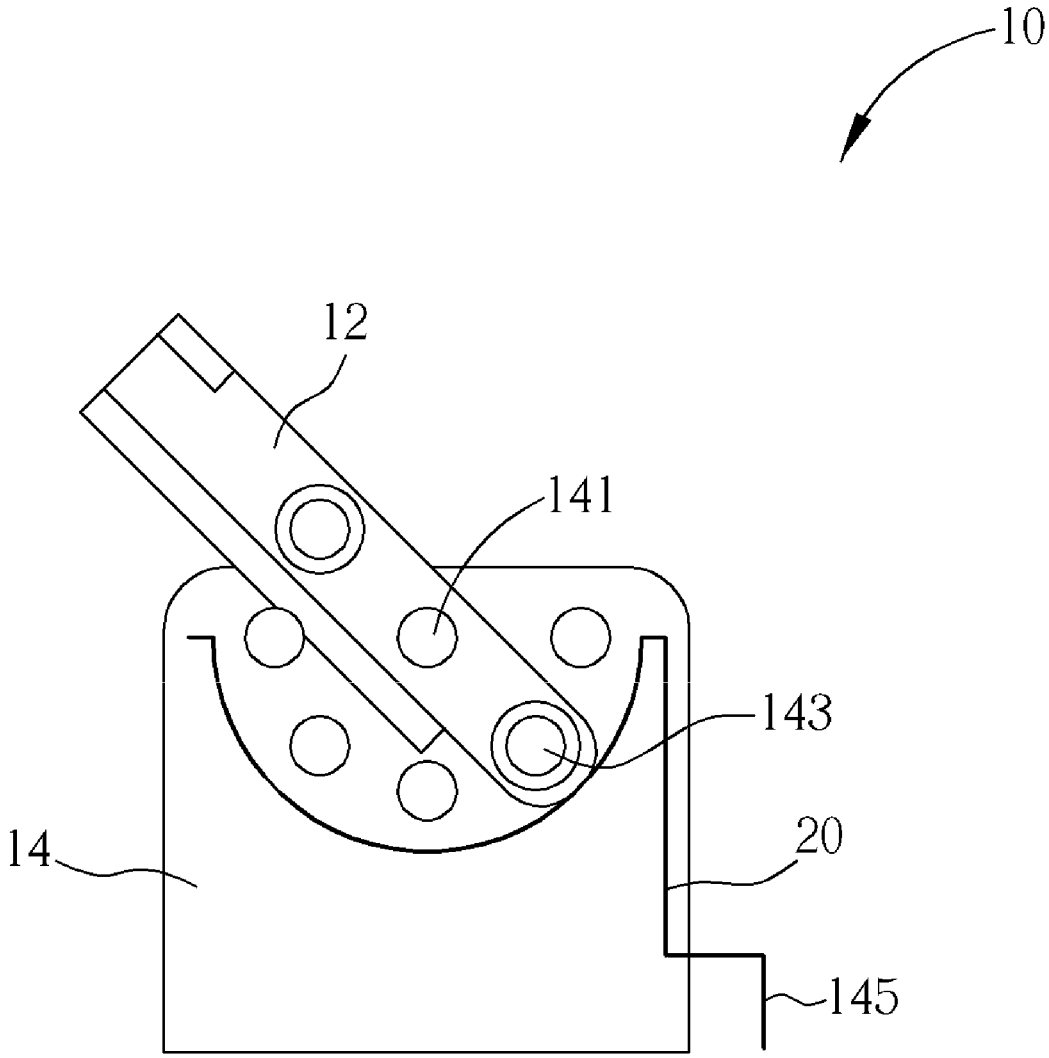

Please refer to FIG. 2. FIG. 2 is a sectional view of the connecting device 10 according to a first embodiment of the present invention. The connecting device 10 further includes an elastic clip 20 electrically connected to the pin set 145 for contacting with the connector 12 so as to transmit the signal between the circuit board 18 and the electronic device 16. The Shape of the elastic clip 20 is not limited to illustration of the first embodiment and can be designed arbitrarily in a presupposition of not affecting a pivoting motion between the connector 12 and the base 14 and an electrical connection between the pin set 145 and the connector 12. Please refer to FIG. 2, FIG. 3, and FIG. 4. FIG. 2 to FIG. 4 are sectional views of the connector 12 of the connecting device 10 at different positions according to the first embodiment of the present invention. Operational principle of components shown in FIG. 2 to FIG. 4 are the same as the one mentioned according to FIG. 1, and the detailed description is omitted herein for simplicity.

Figure 5:
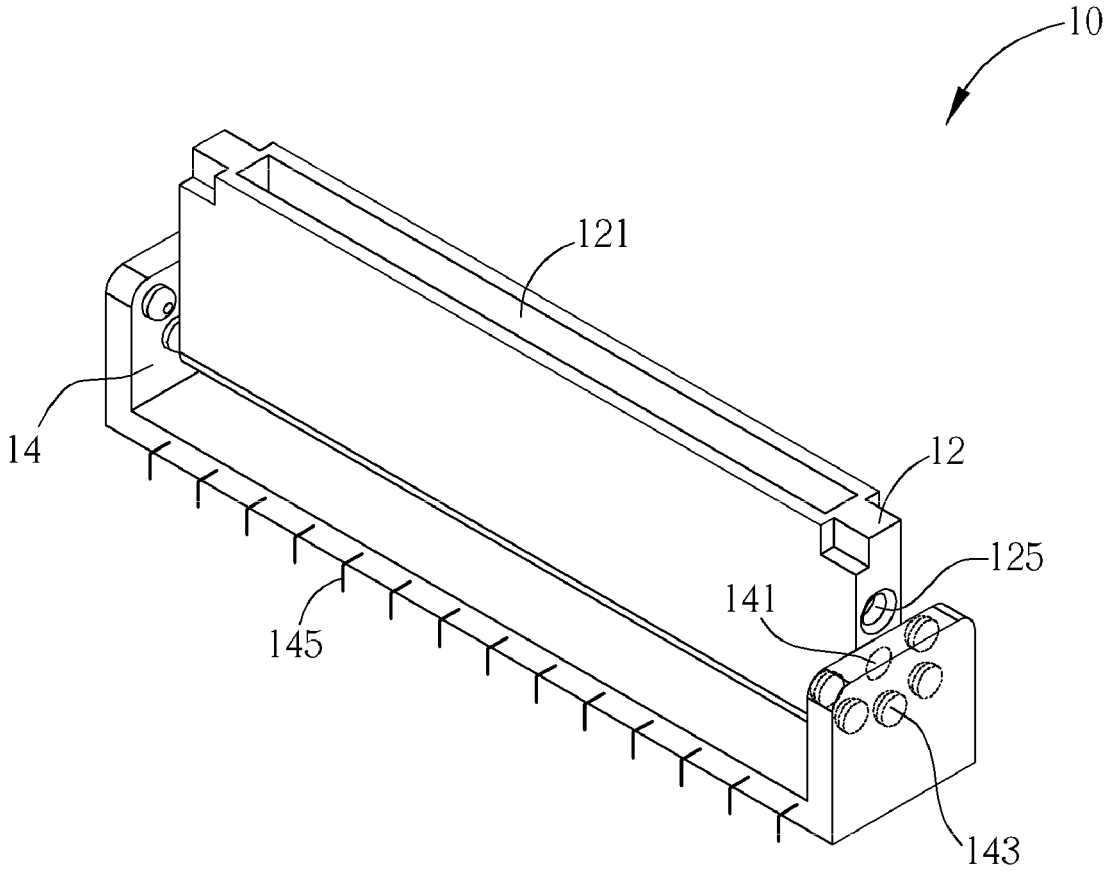
FIG. 5 to FIG. 7 are diagrams illustrating the connector of the connecting device at the different positions according to the first embodiment of the present invention.
Figure 6:
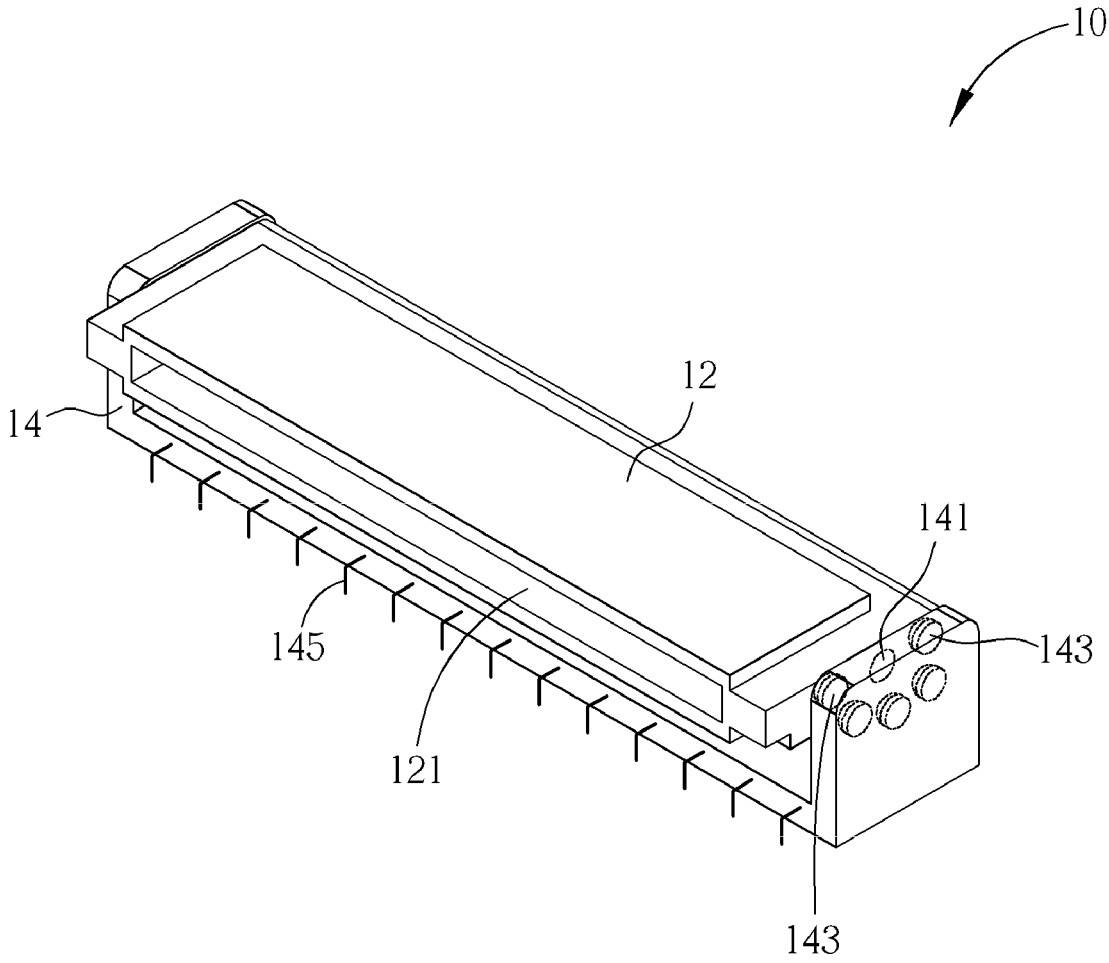
Figure 7:
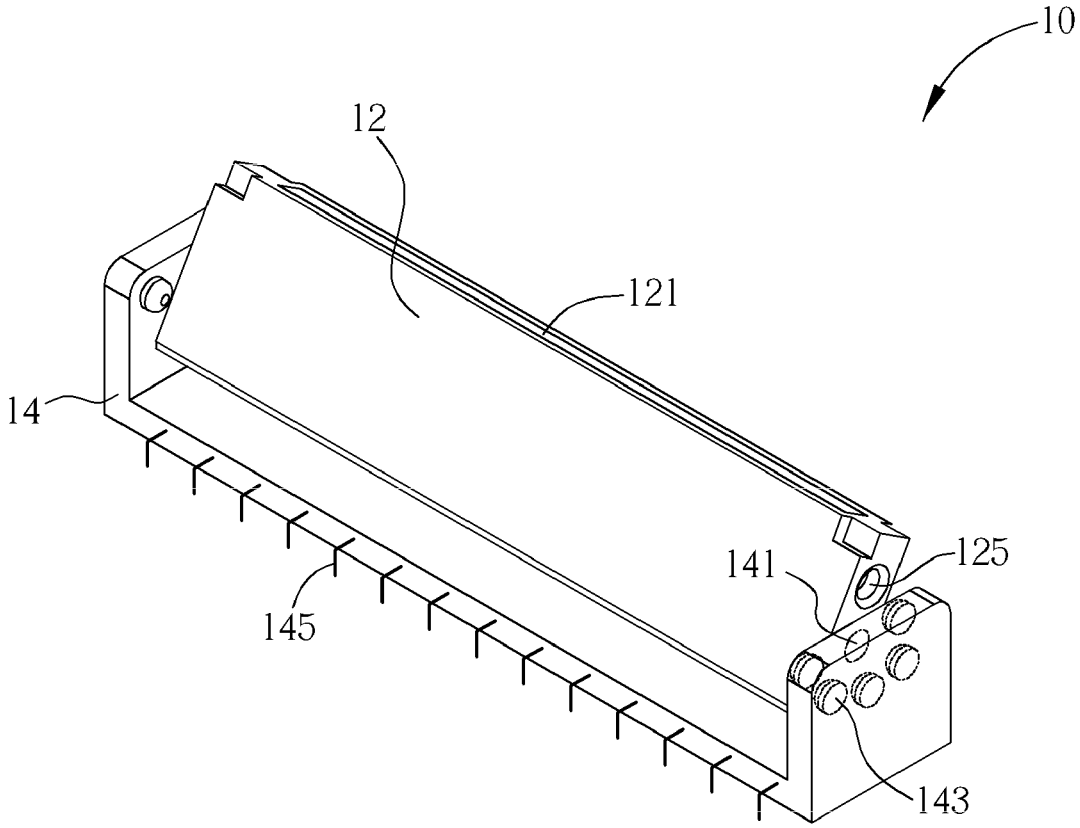

Please refer to FIG. 1, FIG. 5, FIG. 6, and FIG. 7. FIG. 5 to FIG. 7 are diagrams illustrating the connector 12 of the connecting device at the different positions corresponding to FIG. 2 to FIG. 4 respectively according to the first embodiment of the present invention. The first pivoting structure 123 can be a sunken part, and the second pivoting structure 141 can be a protruding structure correspondingly that can be disposed inside the first pivoting structure 123 (the sunken part) in a rotatable manner. In addition, the first positioning structure 125 can be a sunken part, and the second positioning structure 143 can be a protruding structure correspondingly for engaging inside the first positioning structure 125 (the sunken part). Furthermore, the second positioning structure 143 can include a plurality of protrusions for engaging inside the sunken part of the first positioning structure 125 correspondingly when the connector 12 rotates relative to the base 14 at the different positions. Therefore, as shown in FIG. 5 to FIG. 7, the connector 12 can rotate relative to the base 14 and be located at different directions. With demand of a user, the first positioning structure 125 and the second positioning structure 143 can be combined together for fixing relative angles between the connector 12 and the base 14. Operational principle of components shown in FIG. 5 to FIG. 7 are the same as the one mentioned according to FIG. 1, and the detailed description is omitted herein for simplicity.

Furthermore, the second pivoting structure 141 can be the sunken part, and the first pivoting structure 123 can be the protruding structure reversely. It means the first pivoting structure 123 and the second pivoting structure 141 are combined in a pivotable manner, and pivotal means of the first pivoting structure 123 and the second pivoting structure 141 is not limited herein. In addition, the first positioning structure 125 and the second positioning structure 143 can be the sunken part and the protruding structure respectively. The plurality of protrusions of the protruding structure can be arranged as a straight line, disposed around the sunken part, or arranged with the sunken part as a T-shaped structure, so that the relative angle between the connector 12 and the base 14 can be adjusted according to positions of the plurality of protrusions. In another embodiment, the plurality of indentations of the sunken part can be arranged as a straight line, disposed around the protruding structure, or arranged with the protruding structure as a T-shaped structure, so that the relative angle between the connector 12 and the base 14 can be adjusted according to positions of the plurality of indentations of the sunken part.

Figure 8:
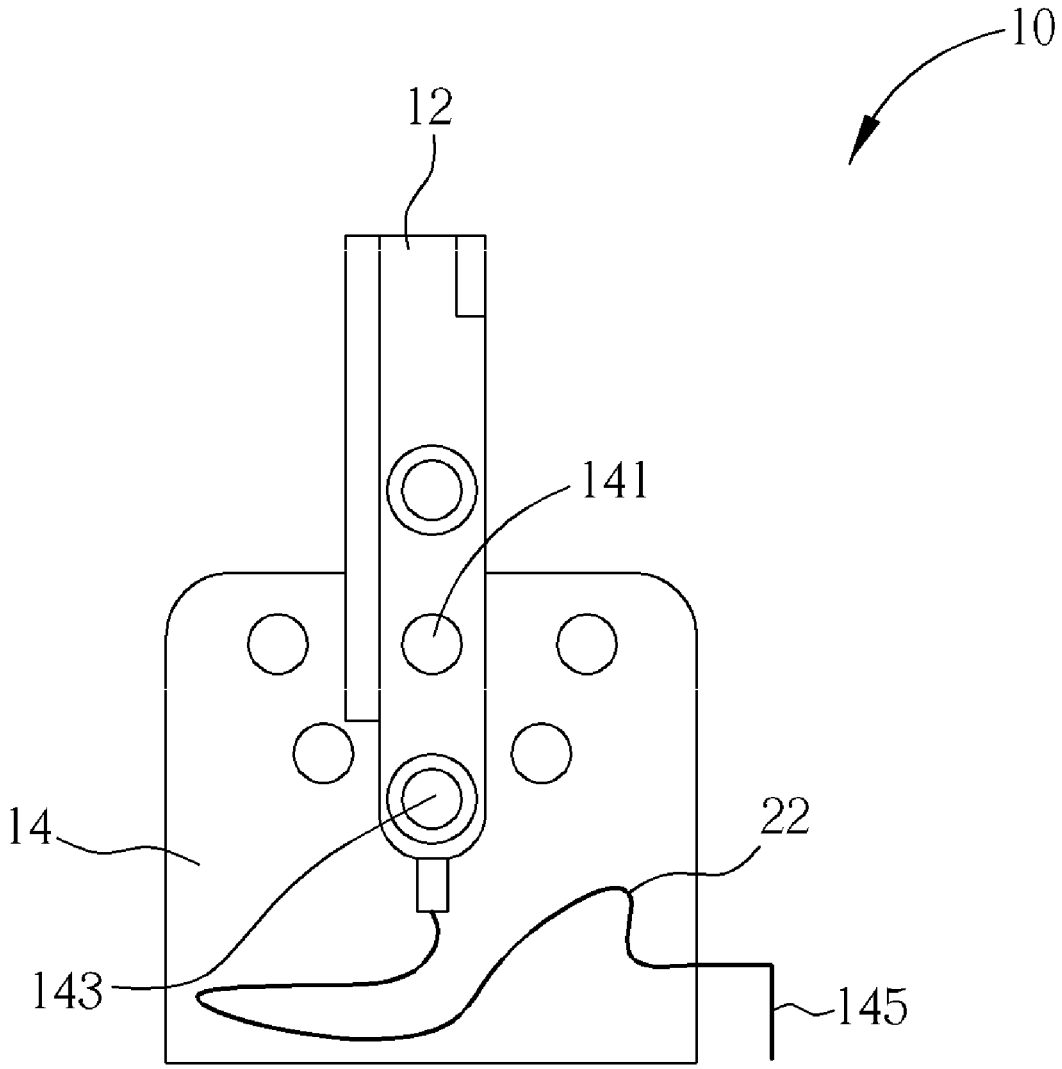
FIG. 8 is a sectional view of the connecting device according to a second embodiment of the present invention.

Please refer to FIG. 8. FIG. 8 is a sectional view of the connecting device 10 according to a second embodiment of the present invention. The connecting device 10 can further include a flexible cable 22 electrically connected to the pin set 145 for contacting with the connector 12 so as to transmit the signal between the circuit board 18 and the electronic device 16. Because the flexible cable 22 is a flat cable with flexibility, the flexible cable 22 can electrically connect to the pin set 145 and the connector 12 stably when the connector 12 rotates relative to the base 14 at the different positions. Operational principle of components shown in FIG. 8 are the same as the one mentioned according to FIG. 1, and the detailed description is omitted herein for simplicity.

Figure 9:
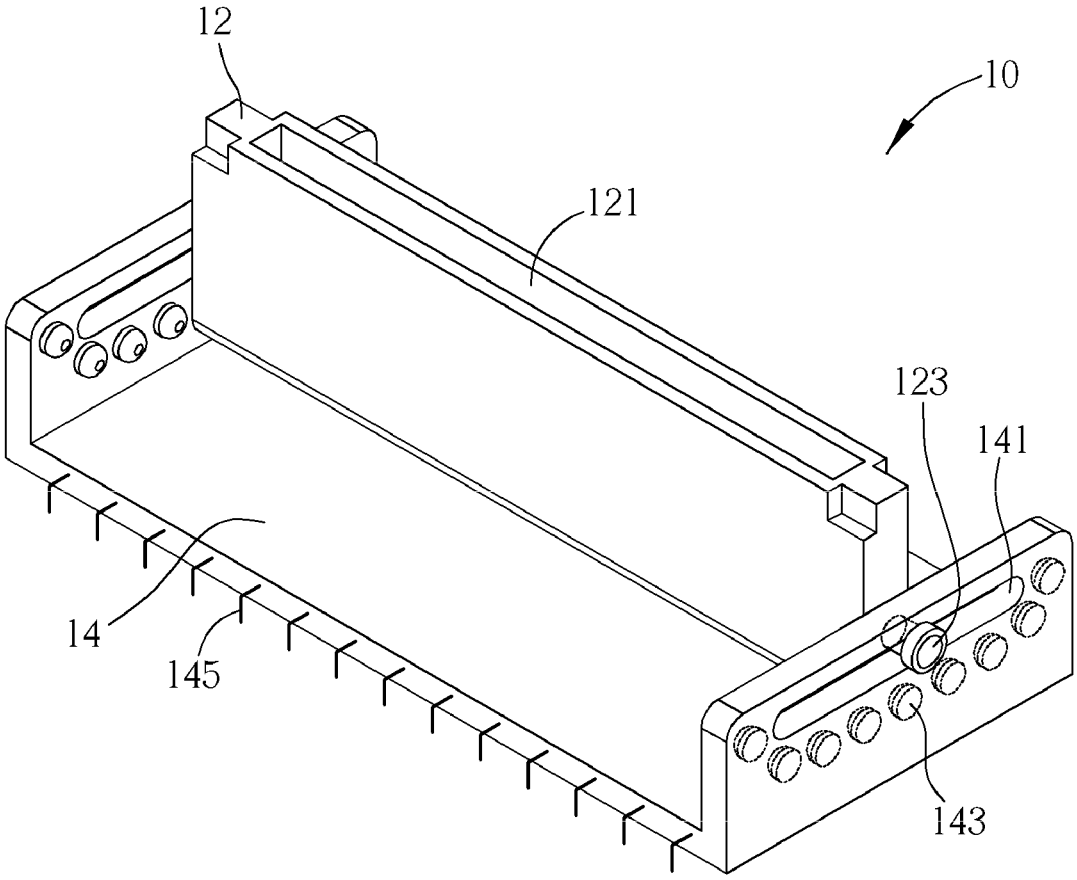
FIG. 9 is a diagram of the connecting device according to a third embodiment of the present invention.

Please refer to FIG. 9. FIG. 9 is a diagram of the connecting device 10 according to a third embodiment of the present invention. The first pivoting structure 123 and the second pivoting structure 141 can be a slot and a protruding structure respectively. The protruding structure can be disposed inside the slot in a slidable and rotatble manner. With pivoting and sliding motions of the first pivoting structure 123 in the second pivoting structure 141 and positioning motions of the first positioning structure 125 and the second positioning structure 143, the connector 12 not only can rotate relative to the base 14, but also can be located at different positions relative to the base 14. Operational principle of components shown in FIG. 9 are the same as the one mentioned according to FIG. 1, and the detailed description is omitted herein for simplicity.

Figure 10:
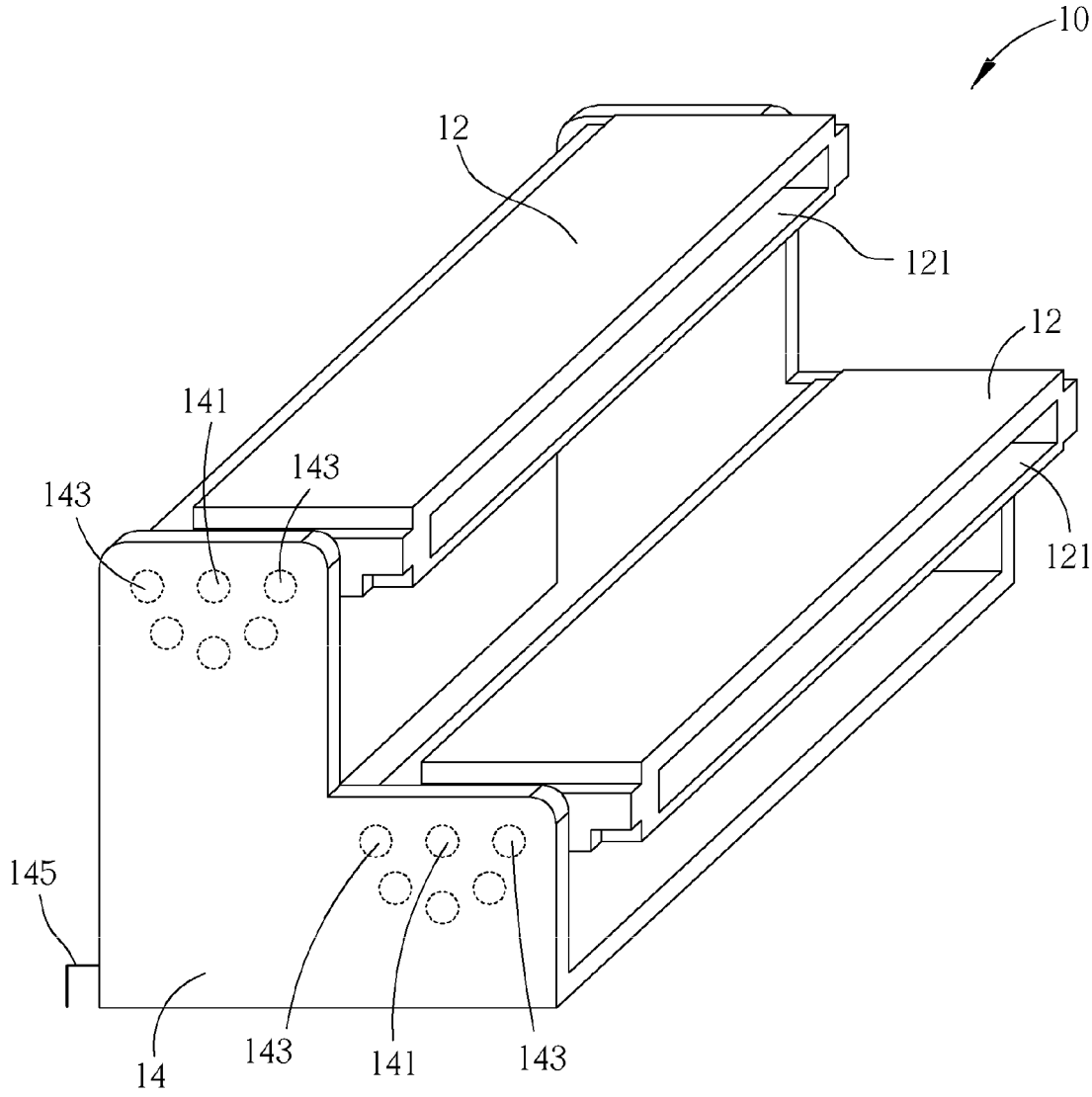
FIG. 10 is a diagram of the connecting device according to a fourth embodiment of the present invention.

Please refer to FIG. 10. FIG. 10 is a diagram of the connecting device 10 according to a fourth embodiment of the present invention. The connecting device 10 can include a plurality of connectors 12, which is stacked on the base 14. With the pivoting motions of the first pivoting structure 123 and the second pivoting structure 141 and the positioning motions of the first positioning structure 125 and the second positioning structure 143, the plurality of connectors 12 can be stacked on the base 14 at different directions and different positions in accordance with the demand of the user. As shown in FIG. 10, the plurality of connectors 12 is stacked on the base 14 substantially in parallel. Operational principle of components shown in FIG. 10 are the same as the one mentioned according to FIG. 1, and the detailed description is omitted herein for simplicity.

Comparing to the prior art, the connecting device of the present invention can adjust the relative angle and the relative position between the connector and the base by way of designing the positioning structures and the pivoting structures, which can be suitable for a variety of the electronic devices currently, such as a SATA interface hard disc and an IDE interface hard disc, and for a variety of the electronic devices with different specifications in the future. The present invention also provides the connecting device whereon the plurality of connectors is stacked. Therefore, the connecting device of the present invention can be suitable for the electronic devices with different specifications, and the relative angle and the relative position between the electronic device and the connecting device can be adjusted.

Those skilled in the art will readily observe that numerous modifications and alterations of the device and method may be made while retaining the teachings of the invention.

What is claimed is:

1. A connecting device comprising:

at least one connector comprising:

a connecting slot for electrically connecting to an electronic device so as to transmit a signal to the electronic device;

a first pivoting structure disposed adjacent to the connecting slot; and a first positioning structure comprising a sunken part disposed adjacent to the connecting slot; and a base for holding the connector, the base comprising:

at least one second pivoting structure pivoted to the first pivoting structure so that the connector rotates relative to the base;

at least one second positioning structure comprising a plurality of protrusions for respectively engaging with the sunken part of the first positioning structure when the connector rotates relative to the base at different positions so as to fix the connector and the base; and at least one pin set electrically connected to a circuit board and the connector so as to transmit the signal between the circuit board and the electronic device.

2. The connecting device of claim 1, wherein the first pivoting structure is a sunken part, and the second pivoting structure is a protruding structure disposed inside the sunken part in a rotatable manner.

3. The connecting device of claim 1, wherein the second pivoting structure is a sunken part, and the first pivoting structure is a protruding structure disposed inside the sunken part in a rotatable manner.

4. The connecting device of claim 1, wherein the plurality of protrusions and the second pivoting structure are arranged collectively as a T-shaped structure.

5. The connecting device of claim 1, wherein the plurality of protrusions is disposed around the second pivoting structure.

6. The connecting device of claim 1, wherein the plurality of protrusions is arranged as a straight line.

7. The connecting device of claim 1, wherein the first pivoting structure and the first positioning structure are disposed on a same side of the connecting slot.

8. The connecting device of claim 1 further comprising:

an elastic clip electrically connected to the pin set for contacting with the connector.

9. A connecting device comprising:

at least one connector comprising:

a connecting slot for electrically connecting to an electronic device so as to transmit a signal to the electronic device;

a first pivoting structure disposed adjacent to the connecting slot; and a first positioning structure comprising a protruding structure disposed adjacent to the connecting slot; and a base for holding the connector, the base comprising:

at least one second pivoting structure pivoted to the first pivoting structure so that the connector rotates relative to the base;

at least one second positioning structure comprising a plurality of indentations for respectively engaging with the protruding structure of the first positioning structure when the connector rotates relative to the base at different positions so as to fix the connector and the base; and at least one pin set electrically connected to a circuit board and the connector so as to transmit the signal between the circuit board and the electronic device.

10. The connecting device of claim 9, wherein the first pivoting structure is a sunken part, and the second pivoting structure is a protruding structure disposed inside the sunken part in a rotatable manner.

11. The connecting device of claim 9, wherein the second pivoting structure is a sunken part, and the first pivoting structure is a protruding structure disposed inside the sunken part in a rotatable manner.

12. The connecting device of claim 9, wherein the second pivoting structure is a slot, and the first pivoting structure is a protruding structure disposed inside the slot in a slidable and rotatable manner.

13. The connecting device of claim 9, wherein the first pivoting structure is a slot, and the second pivoting structure is a protruding structure disposed inside the slot in a slidable and rotatable manner.

14. The connecting device of claim 9, wherein the plurality of indentations and the second pivoting structure are arranged collectively as a T-shaped structure.

15. The connecting device of claim 9, wherein the plurality of indentations is disposed around the second pivoting structure.

16. The connecting device of claim 9, wherein the plurality of indentations is arranged as a straight line.

17. The connecting device of claim 9, wherein the first pivoting structure and the first positioning structure are disposed on a same side of the connecting slot.

18. The connecting device of claim 9 further comprising:

an elastic clip electrically connected to the pin set for contacting with the connector.

19. The connecting device of claim 9 further comprising:

a flexible cable electrically connected to the pin set for contacting with the connector.

20. The connecting device of claim 9 comprising a plurality of connectors stacked on the base.

21. The connecting device of claim 20, wherein the plurality of connectors is disposed on the base substantially in parallel.

* * * * *